US005754157A

United States Patent [19]

Kuwata et al.

[11] Patent Number: 5,754,157

[45] Date of Patent: May 19, 1998

[54] METHOD FOR FORMING COLUMN SIGNALS FOR A LIQUID CRYSTAL DISPLAY APPARATUS

[75] Inventors: Takeshi Kuwata, Yokohama, Japan; Temkar N. Ruckmongathan, Bangalore, India; Toru Ohbiki, Yokohama, Japan; Masami Ito, Tokyo, Japan; Goro Asari, Yokohama, Japan; Takanori Ohnishi, Chiba, Japan

[73] Assignee: Asahi Glass Company Ltd., Tokyo, Japan

[21] Appl. No.: 677,912

[22] Filed: Jul. 10, 1996

Related U.S. Application Data

[63] Continuation of Ser. No. 227,342, Apr. 14, 1994, abandoned.

[30] Foreign Application Priority Data

Apr. 14, 1993 [JP] Japan ..... 5-111045

[51] Int. Cl.[6] ..... G09G 3/36

[52] U.S. Cl. ..... 345/100; 345/507

[58] Field of Search ..... 365/189.04, 189.05; 345/136, 185, 186, 98, 100, 507

[56] References Cited

U.S. PATENT DOCUMENTS

| | | | |
|---|---|---|---|
| 4,755,971 | 7/1988 | Jasmer et al. | 365/189.04 |
| 4,811,245 | 3/1989 | Bunker et al. | 345/136 |
| 4,866,520 | 9/1989 | Nomura et al. | 345/136 |
| 5,091,723 | 2/1992 | Kanno et al. | 345/208 |
| 5,420,604 | 5/1995 | Scheffer et al. | 345/100 |
| 5,475,397 | 12/1995 | Saidi | 345/100 |
| 5,481,651 | 1/1996 | Herold | 345/100 |

FOREIGN PATENT DOCUMENTS 0507061 7/1992 European Pat. Off. .

OTHER PUBLICATIONS

T.J. Scheffer, et al, "Active Addressing Method for High–Contrast Video–Rate STN Display," SID 92 Digest, pp. 228–231.

B. Clifton, et al, "Hardware Architectures for Video–Rate, Active Addressed STN Display," Japan Display '92, pp. 503–506.

"Some New Addressing Techniques for RMS Responding Matrix LCD's" by T.N. Ruckmongathan, Thesis Submitted for the Degree of Doctor of Philosophy, Dept. of Electrical Communication Engineering Indian Institute of Science, Feb. 1988.

"New Addressing Techniques for Multiplexed Liquid Crystal Displays", by T.N. Ruckmongathan and N.V. Madhusudana, Proceedings of the SID, V. 24/3, 1983.

1988 Int'l Display Research Conference, "A Generalized Addressing Technique for RMS Responding Matrix LCDS", by T.N. Ruckmongathan, p. 80–85.

*Primary Examiner*—Amare Mengistu

*Attorney, Agent, or Firm*—Oblon, Spivak, McClelland, Maier & Neustadt, P.C.

[57] ABSTRACT

A method of forming column signals for driving a liquid crystal display apparatus having a plurality of row electrodes and a plurality of column electrodes wherein a plurality of the row electrodes are selected as a batch; the column electrodes are applied with voltages based on orthogonal transformation signals which are obtained by transforming picture signals corresponding to the positions of the simultaneously selected row electrodes on a panel by an orthogonal function, and the row electrodes are applied with the voltages based on the orthogonal transformation signals; the formation of column signals from the picture signals corresponding to the positions of the simultaneously selected row electrodes on the panel includes a serial-parallel transforming step of transforming inputted picture signals into those having a predetermined bit length, a writing/reading step of reading the picture signals having a predetermined bit length after the picture signals have once been written in a memory; and an operating step of transforming by the orthogonal function the picture signals readout from the memory into the orthogonal transformation signals, wherein a random access mode is used for writing the picture signals in the writing/reading step, and data on the row electrodes corresponding to the same column electrodes are stored in an L number of adjoining addresses with respect to an L number of simultaneously selected row electrodes.

13 Claims, 11 Drawing Sheets

| ADDRESS | CONTENT OF MEMORY |
|---|---|
| 0 | ( 1, 1 ) ( 1, 2 ) ---- ( 1, K ) |
| 1 | ( 2, 1 ) ( 2, 2 ) ---- ( 2, K ) |
| 2 | ( 3, 1 ) ( 3, 2 ) ---- ( 3, K ) |
| ⋮ | |
| L-1 | ( L, 1 ) ( L, 2 ) ---- ( L, K) |
| L | ( 1, K+1 ) ( 1, K+2) -- ( 1, 2K) |
| ⋮ | ⋮ ⋮ |

FIGURE 13(a)

*PRIOR ART*

$$V_r \begin{bmatrix} 1 & 1 & 1 & 1 \\ 1 & -1 & 1 & -1 \\ 1 & 1 & -1 & -1 \\ 1 & -1 & -1 & 1 \end{bmatrix}$$

FIGURE 13(b)

*PRIOR ART*

$$V_r \begin{bmatrix} 1 & 1 & 1 & -1 \\ 1 & 1 & -1 & 1 \\ 1 & -1 & -1 & -1 \\ -1 & 1 & -1 & -1 \end{bmatrix}$$

FIGURE 13(c)

*PRIOR ART*

$$V_r \begin{bmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{bmatrix}$$

METHOD FOR FORMING COLUMN SIGNALS FOR A LIQUID CRYSTAL DISPLAY APPARATUS

This application is a Continuation of application Ser. No. 08/227,342, filed on Apr. 14, 1994, now abandoned.

BACKGROUND OF THE INVENTION

1. Field Of The Invention

The present invention relates to a method of driving a liquid crystal display apparatus suitable for a liquid crystal having a fast responding characteristic. In particular, the present invention concerns a passive matrix type liquid crystal display apparatus in which a multiple line selection method (a MLS method as described in Japanese Unexamined Patent Publication No. 27907/1994 and U.S. Pat. No. 5,262,881) is used for multiplex driving. Specifically, the present invention relates to the basic construction of a circuit which is for data processings, i.e., which receives data to be displayed so that the data are operated in accordance with the MLS method and the operated data are supplied to a display driver.

2. Discussion Of Background

Hereinbelow, data electrodes are referred to as column electrodes, and scanning electrodes are referred to as row electrodes.

Heretofore, a liquid crystal display element responding to the effective value of a voltage applied, such as a supertwisted nematic (STN) liquid crystal element has been practically used. In order to improve the switching speed for a display, a liquid crystal element having a fast responding characteristic has been desired. However, the liquid crystal element having a fast responding characteristic had a problem that an optical difference was small between an ON state and an OFF state whereby contrast was poor.

As a generally used liquid crystal driving method, there is a successive line addressing method which selects and drives for each scanning line, each element of a liquid crystal element in which the elements are arranged in a matrix form. When the successive line addressing method is used for a liquid crystal element having a response time of about 200 msec which is not so high, the response time is relatively long in comparison with the period of the waveform of a voltage for the successive line addressing method. However, when the response time is as short as about 20–100 msec, the response time becomes close to the period of the waveform of the voltage for the successive line addressing method. As a result, it happens that a pixel which is in an ON state in a selection period in the successive line addressing returns to be in an OFF state during a non-selection period. Namely, the difference of brightness between the ON state and the OFF state is small. Such phenomenon is called a frame response.

In order to eliminate the frame response, it is considered to increase the frequency of the voltage for the successive line addressing in response to an increased response speed of the liquid crystal element. However, a high frequency causes ununiformity in a display because the frequency spectrum of a voltage waveform applied to the element becomes high.

As a driving method to eliminate the above-mentioned problem, a multiple line selection method (MLS method) for selecting a plurality of scanning lines as a batch is proposed. When a plurality of scanning lines are simultaneously selected for driving, a period of selection signals applied to a single row electrode can be shortened without changing the pulse width of the selection signals. As a method of simultaneously selecting a plurality of lines, there are a method of simultaneously selecting all scanning lines as described in SID '92 DIGEST (1992) P. 228 and a method of simultaneously selecting a plurality of scanning lines (MSL method) which are less than all scanning lines described in SID '92 DIGEST (1992) P. 238.

In either method, signals having a plurality of levels are used. When two levels of the selection signals are expressed as +1 and −1, the time sequence of each of the selection signals given to the scanning lines simultaneously selected is an orthogonal function formed by +1 and −1. When data corresponding to ON and OFF of a display are expressed by +1 and −1, the signal lines for providing display data are supplied with voltages based on a result of comparison of the orthogonal function with each of the data.

In a successive line addressing method using 1/N duty driving and an alternating voltage in two frames, the first through the N th row electrodes which correspond to the scanning lines are scanned by positive selection outputs, and then, the first through the N th row electrodes are scanned by negative selection outputs whereby an alternating waveform is performed. Thus, a display sequence is finished. Namely, each of the row electrodes is scanned twice in a display sequence constituted by two frames. In this case, a single row electrode is selected at once, and accordingly, it is enough to use a single row electrode driver for controlling the polarity of voltage applied.

On the other hand, when the MLS method is used wherein the selection period and the frame period are the same as those in the successive line addressing method, each of the scanning lines can be scanned around L times in a single display sequence wherein L is the number of scanning lines simultaneously selected. In this case, if selection signals for the scanning lines are distributed in the single display sequence, the period of the selection signals applied to the row electrode can be short. Namely, the reduction of the optical difference (between an ON state and an OFF state) of the liquid crystal element can be suppressed in comparison with a case of the successive line addressing method. Accordingly, a driving method applicable to a fast responding element can be realized. In this case, however, it is necessary to control independently the polarity of the row electrodes corresponding to a plurality of selected scanning lines. FIG. 12 shows an example of the waveform of row electrodes when L=3. In FIG. 12, R1–R9 respectively show row electrodes.

If conventional row electrode drivers are used to control independently the polarity of voltages applied to an L number of row electrodes simultaneously selected, an L number of drivers are needed. When the value L is taken large, the scale of the circuit becomes large to thereby make the liquid crystal display apparatus expensive. In other words, the value of L has to be an appropriate value while the frame response be minimized.

The inventors of this application proposed a driving method of liquid crystal wherein an L number of scanning lines are simultaneously selected and the polarity of the row electrodes is effectively controlled, in Japanese Unexamined Patent Publication Nos. 27904/1994, 27907/1994 and U.S. Pat. No. 5,262,881. The proposed methods will be described in brief.

Supposing that voltages applied to each of the row electrodes are either $+V_r$ or $-V_r$ ($V_r>0$) when selection signals are active, and are 0 in a non-selection time. An N number of row electrodes are divided into an L number of groups, and an L number of row electrodes in a group are simultaneously selected. For simplification, assuming that N is an integer multiplied by L, and N=M×L. Namely, the number of groups is M. Further, groups consisting of simultaneously selected row electrodes are referred to as row electrode subgroups. Row electrodes forming a single row electrode subgroup are not always necessary that they are continuously arranged. A row electrode subgroup may be formed by gathering row electrodes positioned separately.

Selection voltages applied to the row electrodes forming the m th (m is any one of 1-M) row electrode subgroup selected, can be expressed by the arrangement of the L order of vectors in time sequence, the vectors being based on voltages applied to the row electrodes. The arrangement of the vectors in time sequence is referred to as a selection voltage matrix. Further, column vectors which form a selection voltage matrix are referred to as selection voltage vectors. After the determination of the selection voltage matrix, each element of the selection voltage vectors which form a selection voltage matrix is applied as voltages to the corresponding row electrodes. The voltage is applied successively to each of the row electrode with respect to the all selection voltage vectors, whereby the selection of a single row electrode subgroup is completed.

In the following, explanation is made as to a method of forming the selection voltage matrix. First, a matrix (orthogonal matrix) A=[α1, α2, . . . . αk] comprising L rows and K columns, which has an element of $+V_r$ or $-V_r$ and in which the product of a matrix and a transposed matrix of the same assumes a scalar multiple of a unit matrix, is selected, where αq (q=1-K) are appropriate column vectors having an L number of elements, and K is an integer of K≧L (q is a natural number). When K is determined to be excessively large, the number of selection pulses necessary to select the row electrodes is large. Accordingly, it is preferable that K may be the smallest value as possible.

FIG. 13 shows a concrete example of a matrix A wherein L=4, 8 and K=4, 8. In a case of $L \neq 2^P$, the L-row-K-column matrix A can be formed by removing an optional (K-L) rows from a K order matrix wherein the product of a matrix and a transposed matrix of the same forms a scalar multiple of the unit matrix.

In the above-mentioned Japanese Unexamined Patent Publication Nos. 27904/1994 and 27907/1994 and U.S. Pat. No. 5,262,881, there is statement that as the selection voltage matrix a matrix of vectors wherein the selection voltage vectors composed of at least α1, α2, . . . . αk, −α1, −α2, . . . . −αk are arranged, is selected. Namely, the selection voltage matrix composed of the 2K number of vectors wherein each of the vectors appears once in the selection voltage matrix can be selected. By using such method of selection, the driving of the liquid crystal element in an alternating form is generally obtainable.

The number of the column vectors forming the selection voltage matrix may be increased. For instance, when L=4, all possible conditions of electric potential in the row electrode subgroups is $2^4$=16. Accordingly, selection voltage matrices including 16 kinds of selection voltage vectors can be formed. Further, the order of the arrangement in time sequence of the selection voltage is optional. The order may be substituted or shifted each time when the selection of a row electrode subgroup is finished, or it may be substituted each time when a display sequence is finished. It is preferable to carry out the substitution to control ununiformity of display.

Description will be made as to timing to apply the selection voltages expressed by the selection voltage vectors to each of the row electrodes. In order to suppress the frame response of the fast responding liquid crystal element, it is desirable that the selection signals are dispersed in a display sequence to reduce the length of a non-selection period with respect to each of the row electrodes. In other words, the selection signals (voltages) should not be continuously applied to a row electrode subgroup in accordance with each pattern which is shown by selection voltage vectors, but the voltages composed of a single or some selection voltage vectors should be applied to a row electrode subgroup, and the same voltages be used for controlling another row electrode subgroup. Generally, an increased number of the division of the selection voltage vectors is effective to suppress the frame response since the non-selection period can be reduced. Further, it is preferable to uniformly disperse the selection signals. Thus, after the voltages composed of one or some selection voltage vectors have been applied to a row electrode subgroup, the voltages are applied to another row electrode subgroup.

Signals applied to column electrodes to which display signals are provided are determined as follows. Supposing that a series of data β are composed of selected voltage vectors wherein an element of $+V_r$ is 1 and an element of $-V_r$ is 0, and a series of data γ correspond to each of selected row electrodes, among data to be applied to row electrodes. Exclusive OR is applied to elements between the series of β and the series of γ. And then, an arithmetical sum is obtainable from a result of the application of the operations. Accordingly, when there are an i number of elements which have different values, the arithmetical sum is i. Then, voltage a to be applied to the column electrode is Vi.

In this case, Vi is selected from an (L+1) number of voltage levels where $V_O$<Vl< . . . <$V_L$. The absolute value of the voltage levels is determined by a threshold voltage and so on of the liquid crystal element. It is desirable that the values are selected so that the column voltages form an alternating form. When $V_i$=((2i-L)/L)$V_c$, and $V_r$=($N^{1/2}$/L) $V_c$, the ratio $V_{ON}/V_{OFF}$ of the voltage effective value can be the maximum where $V_c$ is the maximum value in voltages applied to the column electrodes. Conditions other than the above-mentioned conditions may be employed. Namely, $V_i$ and $V_r$ may be adjusted so that the best contrast ratio is obtainable in the vicinity of the conditions.

When display data are not shown by two values, but has a gradation degree, the gradation degree can be obtained by a frame modulation method. Further, an amplitude modulation method as proposed in Japanese Application No. 269560/1992 and U.S. Ser. No. 08/098,812 may be used.

The above description concerns a case of N=M×L. However, when the number of row electrodes which form each row electrode subgroup can not be made equal, it is considered to use dummy row electrodes so that the number of row electrodes forming each row electrode subgroups is equal.

Generally, the frequency of picture signals inputted is different from the frequency of a display cycle on the side of the liquid crystal display element. In general, the pulse width of the waveform of a signal for driving the liquid crystal display element is determined to be about 10 nsec through several tens nsec from the viewpoints of number of scanning lines and easiness of viewing a display. Accordingly, the frequency of a display cycle is often determined to be about 100 Hz–200 Hz although it depends on the number of scanning lines. On the other hand, the frequency of picture signals inputted is often determined to be about 60 Hz.

Accordingly, it is necessary to adjust timing in signal processing. In general, such an adjustment is conducted by writing once the picture signals in a memory and by reading-out the written data so as not to be in synchronism with the timing of the writing of the picture signals. Namely, the writing memory is used separately from a reading memory so that the picture signals are written in the writing memory in response to input timing and the written data are read out from the reading memory in response to the timing of a display cycle.

Since successive line selection is conducted in a conventional driving method without using the MLS method, voltages to be applied to the column electrodes are determined when picture signals for a column electrode on a specified scanning line are determined. Accordingly, it is basically sufficient for the conventional driving method to have only one memory.

In the MLS method for the present invention, however, a plurality of row electrodes are simultaneously selected. Accordingly, voltages to be applied to column electrodes are determined by operating signals to be applied to the simultaneously selected row electrodes and picture signals on the simultaneously selected row electrodes. Namely, data of a pixel are divided and stored in a plurality of memories (the member corresponding to the number of simultaneously selected row electrodes), and data are read out for operation, in parallel, from the memories.

When the conventional method is used without modification, it is necessary to use the same number (a three-fold number is required if there are colors for R, G and B) of memories and the number of the simultaneously selected row electrodes. For instance, in a conventional color liquid crystal display wherein L=7, it was necessary to use a 3×7=21 number of fast memories since each data of R, G and B had to be treated in parallel. Further, when it was necessary to write data in memories and to read the written data from the memories simultaneously, it was necessary to use 42 memories wherein there were 21 memories for reading and 21 memories for writing.

Generally, the memories used are classified into three kinds as follows. The first is a static random access memory (SRAM), the second is a dynamic random access memory (DRAM), the third is a video random access memory (VRAM). The SRAM has a fast responding characteristic wherein a time for writing data in and a time for reading the data from the memory are 20 ns–30 ns. However, the cost is the most expensive. In the DRAM, although a time of writing data into a memory and reading the data from the memory are low as 150 ns–200 ns, the cost is most inexpensive. The VRAM is similar to DRAM except that a serial access memory (SAM) as an input/output port is additionally provided. The VRAM exhibits a fast responding characteristic as about 30 ns when data are written in the memory or the data is read out from the memory keeping a certain level of regularity (i.e., when a serial accessing method is conducted). However, it exhibits a low responding characteristic as 150 ns–200 ns when the data are randomly written in the memory and the data are read out from the memory (i.e., when a random access method is conducted). The cost is low next to the DRAM.

In the conventional method, it is necessary to use a large number of expensive SRAMs in order to read out data from memories at a speed corresponding to a display cycle. Accordingly, the cost is increased. Further, the MLS method has an inherent problem that the data of column signals have to be arranged in a form suitable to conduct operations at the front stage of an operating circuit for the column signals.

SUMMARY OF THE INVENTION

It is an object of the present invention to provide a method of forming column signals which is suitable for driving a liquid crystal display apparatus by using a MLS method, and which is capable of reducing the number of memories to be used and reducing cost.

The foregoing and other objects of the present invention have been attained by providing a method of forming column signals for driving a liquid crystal display apparatus having a plurality of row electrodes and a plurality of column electrodes wherein a plurality of the row electrodes are selected as a batch; the column electrodes are applied with voltages based on orthogonal transformation signals which are obtained by transforming picture signals corresponding to the positions of the simultaneously selected row electrodes on a panel by an orthogonal function, and the row electrodes are applied with the voltages based on the orthogonal function, the method being characterized in that the formation of column signals from the picture signals corresponding to the positions of the simultaneously selected row electrodes on the panel comprises:

a serial-parallel transforming step of transforming inputted picture signals into those having a predetermined bit length, a writing/reading step of reading the picture signals having a predetermined bit length after the picture signals have once been written in at least one memory; and an operating step of transforming by the orthogonal function the picture signals readout from the at least one memory into the orthogonal transformation signals, wherein a random access mode is used for writing the picture signals in the writing/reading step, and data on the row electrodes corresponding to the same column electrodes are stored in an L number of adjoining addresses with respect to an L number of simultaneously selected row electrodes.

In a preferred embodiment of the present invention, a serial access mode which is faster than the random access mode is used for reading picture signals in the writing/reading step.

In a preferred embodiment of the present invention, when the liquid crystal display apparatus is driven, a picture consists of a plurality of successive subpictures and the subpictures are continuously displayed to obtain a gray shade display. Further, a gray shade determining step is used to form picture signals for the subpictures by transforming the picture signals into data of 1 bit for each 1 dot·1 color after the writing/reading step.

In another preferred embodiment of the present invention, when the liquid crystal display apparatus is driven, a picture consists of a plurality of successive subpictures and the subpictures are continuously displayed to obtain a gray shade display. A gray shade determining step is used to form picture signals for the subpictures by transforming the picture signals including a gray shade level into data of 1 bit for each 1 dot·1 color before the serial-parallel transforming step.

In another preferred embodiment of the present invention, a length-breadth transforming step is used to transform an L number of continuous data having a K bit length into a K number of continuous data having an L bit length before the operating step wherein the number of simultaneously selected row electrodes is L.

Further, in another preferred embodiment of the present invention, when the operating step is conducted including the operation of transforming by the orthogonal function, the picture signals read out from the memory into the orthogonal transformation signals, correction signals are formed to be included in the column signals so that effective voltages to be applied to pixels in a non-selection time take substantially the same value to the pixels.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein:

FIGS. 13*a*, 13*b* and 13*c* are diagrams showing selection voltage matrices.

DETAILED DESCRIPTION OF PREFERRED EMBODIMENTS

Preferred embodiments of the present invention will be described with reference to the drawings.

A liquid crystal display element used for the present invention is driven by the driving method proposed by the inventors of this application as described in Japanese Unexamined Patent Publication Nos. 27904/1994 and 27907/1994 and U.S. Pat. No. 5,262,881. Namely, row electrodes of a liquid crystal display element comprising a plurality of row electrodes and a plurality of column electrodes are divided into an M number (M is an integer of 2 or more) of row electrode subgroups, which are respectively selected as batches to be driven.

The liquid crystal display element used for the present invention is preferably of a fast responding characteristic. The fast responding type liquid crystal display element is obtainable by reducing the thickness d of the liquid crystal layer and using liquid crystal having a low viscosity and a large refractive index anisotropy. Liquid crystal material which satisfies such conditions may be a tolan series (disclosed in Japanese Unexamined Patent Publication No. 5631/1986), a difluorostilbene series liquid crystal (disclosed in Japanese Unexamined Patent Publication No. 96475/1964) or the like.

In this text, a random access means that data have addresses indicating physical positions and the data are read out from or stored in a memory in an order irrelevant of the relative position of data, and a serial access means that data are stored in a memory in a predetermined order or the data are read out from the memory in a predetermined order.

Figure 1:
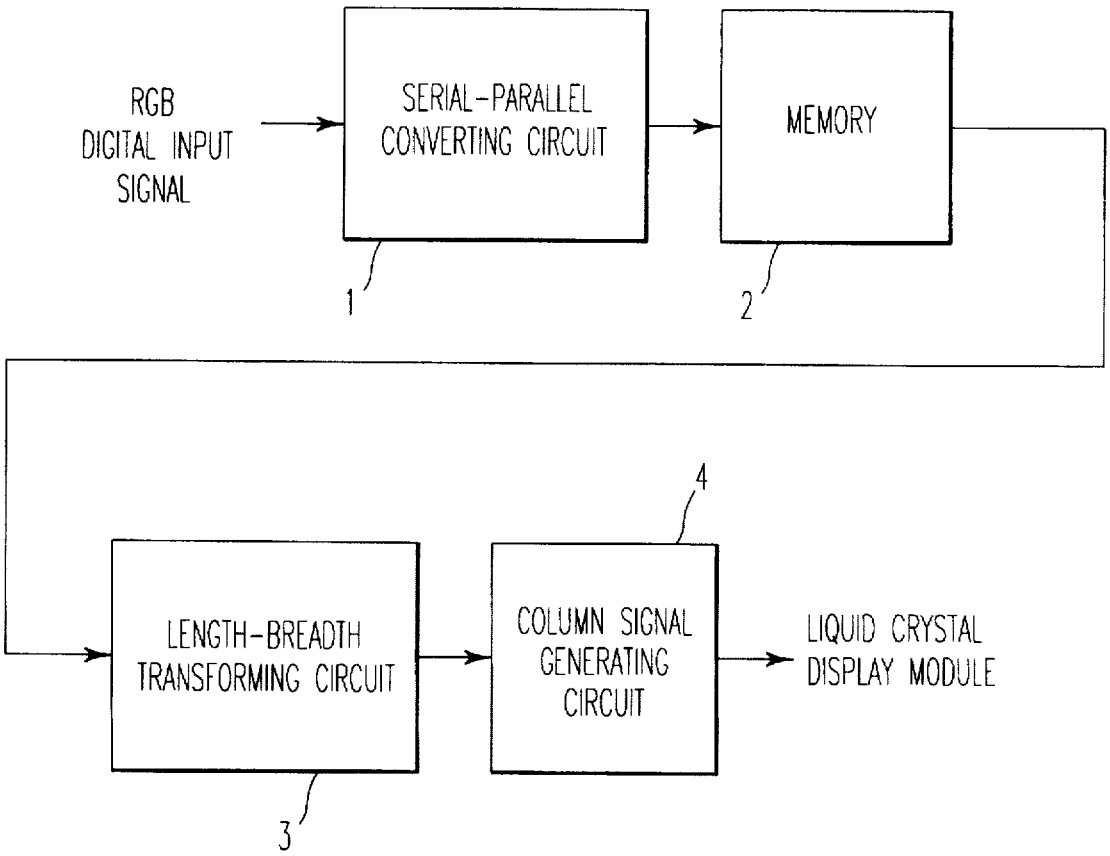
FIG. 1 is a block diagram showing the method of the present invention schematically.

An operating circuit for operating picture signals used for the present invention basically comprises a serial-parallel transforming circuit 1, a memory (mainly VRAM) 2, a length-breadth transforming circuit 3 and a column signal generating circuit 4 as shown in FIG. 1.

Assuming that signals to be inputted are digital signals in which information of colors R, G and B is included in parallel; digital data corresponding to each pixel of a picture to be displayed are successively transferred from the left side of the first line to the lateral direction; when the data of the first line have been transferred, the data of the second line is transferred, and in this manner, picture signals of groups of R, G and B (for 1 pixel) are transferred. The picture signals are transformed into parallel data for K pixels in the serial-parallel transforming circuit 1 and the transformed parallel data are written in a memory 2 at a low data transferring speed.

Figure 2:
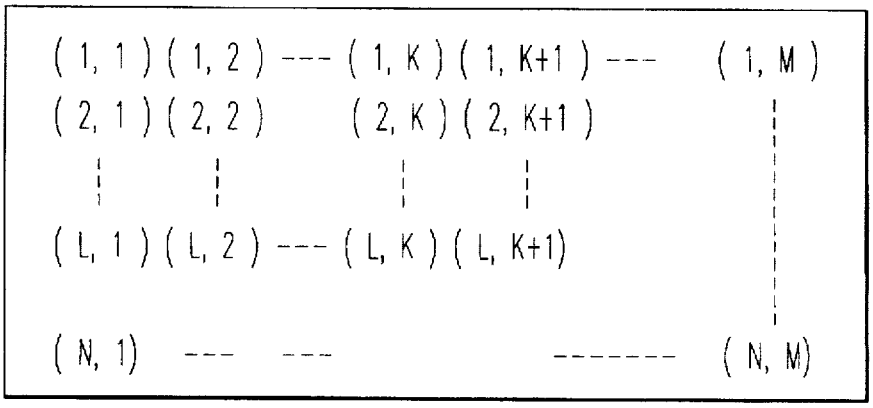
FIG. 2 is a diagram showing how data are defined in a display picture.
Figures 3, 4:
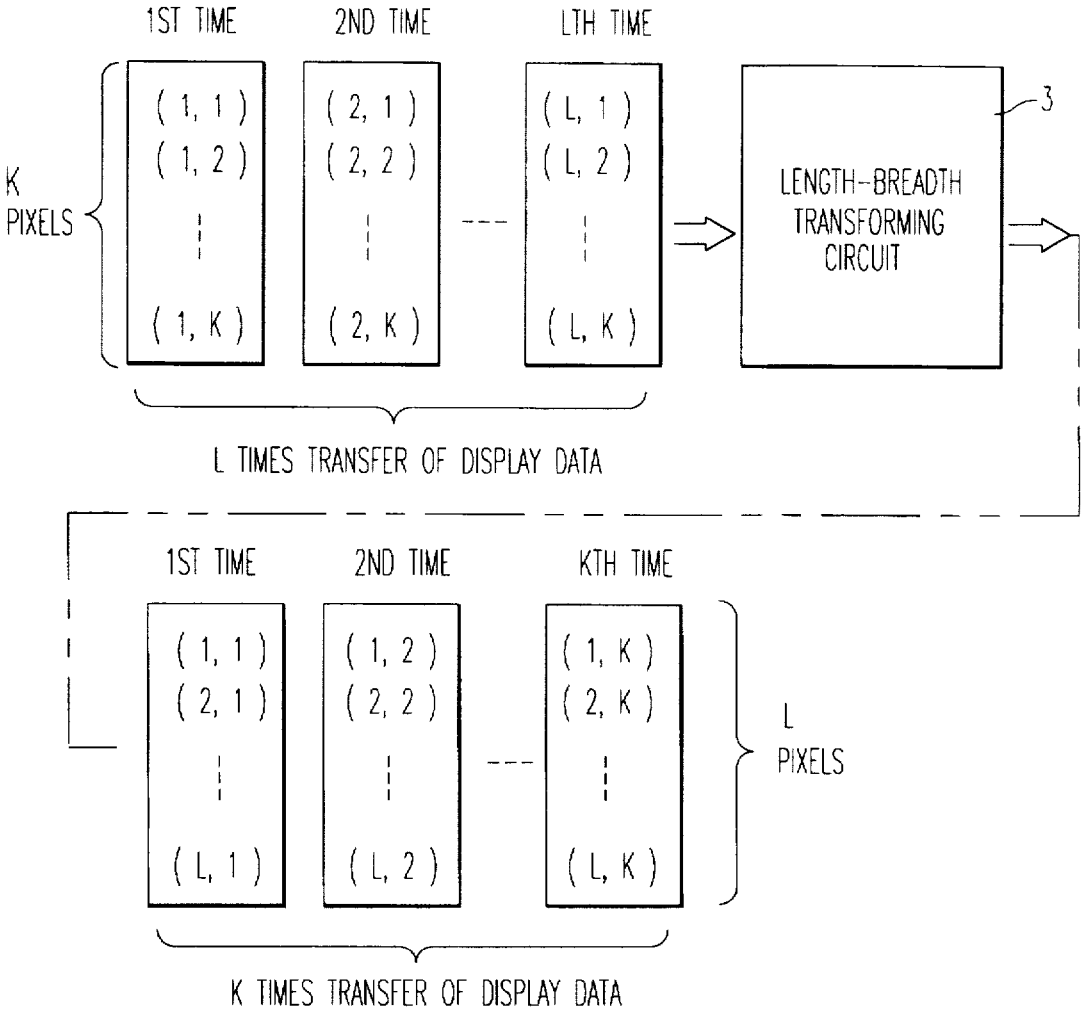
FIG. 3 is a diagram showing how data are arranged on a memory.
FIG. 4 is a diagram showing the function of a length-breadth transforming circuit.

FIG. 2 shows the definition of data on a picture to be displayed and FIG. 3 shows an arrangement of the data on a memory. Namely, the data of an L number of simultaneously selected row electrodes, which correspond to the same column electrodes, are stored in an L number of adjoining addresses.

The data are written in a memory with the above-mentioned arrangement. The data written in the memory are read out so as to be operated at the post-stage. The DRAM may be used. However, the VRAM provided with a fast serial access mode is preferably used in order to increase the speed of operation which is conducted at a later stage. The data stored in the memory are read out by utilizing the fast serial access mode to be transferred to the length-breadth transforming circuit.

The length-breadth transforming circuit 3, which may be used as necessary, is such a circuit that as shown in FIG. 4, the display data of K pixels which are transferred L times are stored, and the stored data are read out as the data of L pixels which are divided into K, namely, serial data of K pixels are transformed into serial data of L pixels. The length-breadth transforming circuit 3 can adjust a data length in a case that the data length of a memory is smaller than the data length which is necessary for a column signal generating circuit 4 disposed at a later stage. Thus, the data of L pixels necessary for operating column voltages are continuously outputted from the length-breadth transforming circuit 3 and are transferred to the operating circuit (the column signal generating circuit 4).

The column signal generating circuit 4 performs operations by using the display data of L pixels and a row electrode selection pattern of a plurality of simultaneously selected row electrodes (the orthogonal transformation described before, and the data are supplied to an exclusive OR gate, followed by subjecting to the arithmetical sum) to thereby produced column electrode signals. The column electrode signals are transferred to a liquid crystal display module along with requisite timing signals.

Examples of the present invention will be described. However, the present invention should not be limited to the Examples.

EXAMPLE 1

Figure 5:
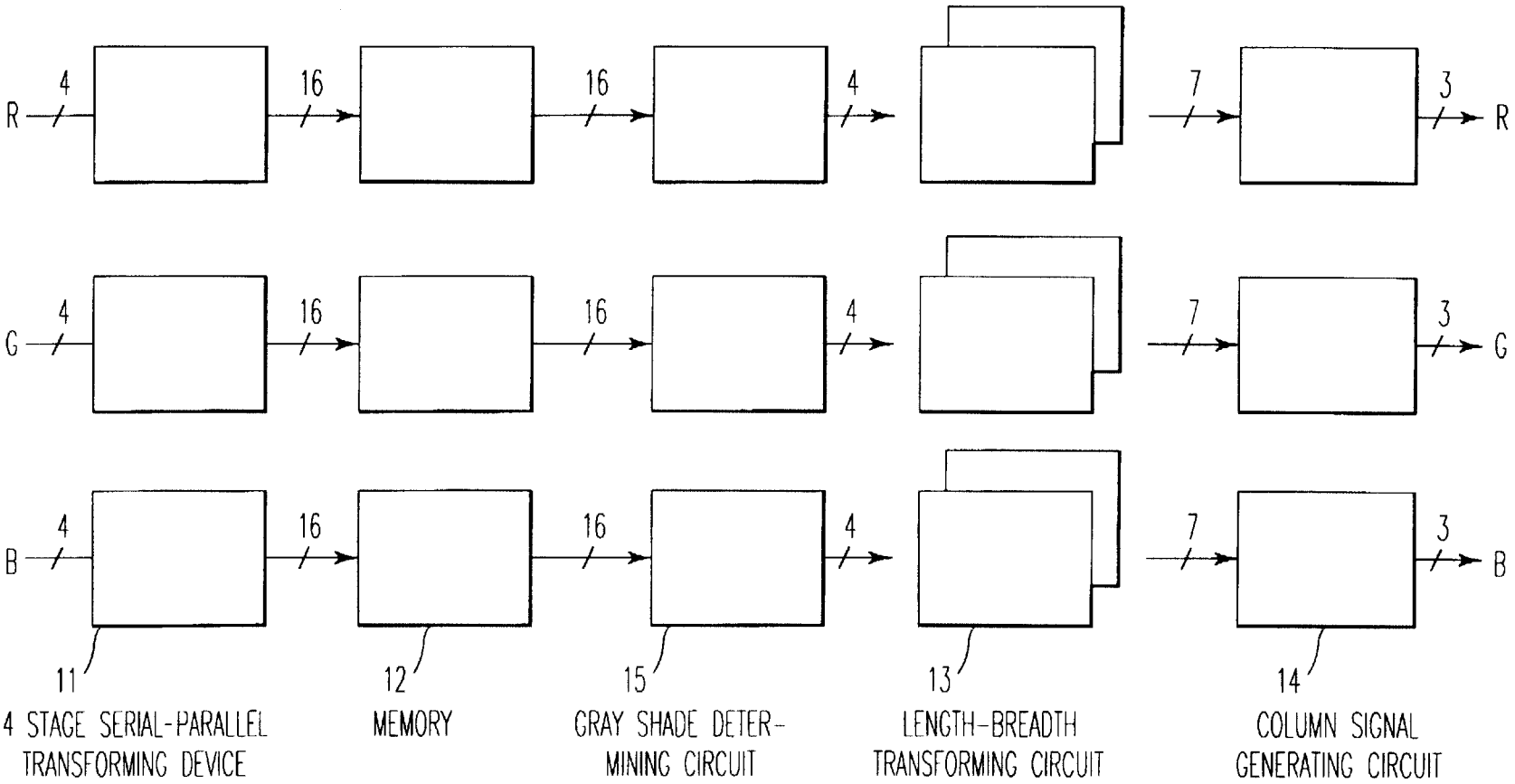
FIG. 5 is a block diagram showing a first embodiment of the present invention.

FIG. 5 shows an example of driving a liquid crystal display panel comprising 320×3×240 dots with use of three memories. Supposing that the number of simultaneously selected lines is L=7 and a 16 gray shade display (i.e. 4-bit data are inputted for each color of R, G, B) is provided by frame modulation (e.g. Japanese Unexamined Patent Publication No. 27904/1994 or U.S. Pat. No. 5,262,881). Description will be made as to signal processing for only one color since a data signal processing is conducted in parallel and independently for each color of R, G and B.

4-bit data are inputted to a 4-stage serial-parallel transforming device 11 where the 4-bits data are transformed into 16-bit data and are supplied to a memory 12. A 4-stage shift register was used for the 4-stage serial-parallel transforming device 11. Namely, serial data are inputted to an input terminal of the 4-stage shift register, and an output from 4 tap terminals is inputted to the memory 12. A VRAM having a 16 bit length is used for the memory. The data are written in the memory by using a random access mode in a format as shown in Table 1.

TABLE 1

| Address | Data of memory | | | |
|---|---|---|---|---|
| 0 | (1, 1) | (1, 2) | (1, 3) | (1, 4) |
| 1 | (2, 1) | (2, 2) | (2, 3) | (2, 4) |
| 2 | (3, 1) | (3, 2) | (3, 3) | (3, 4) |
| 3 | (4, 1) | (4, 2) | (4, 3) | (4, 4) |
| 4 | (5, 1) | (5, 2) | (5, 3) | (5, 4) |
| 5 | (6, 1) | (6, 2) | (6, 3) | (6, 4) |
| 6 | (7, 1) | (7, 2) | (7, 3) | (7, 4) |
| 7 | (1, 5) | (1, 6) | (1, 7) | (1, 8) |
| 8 | (2, 5) | (2, 6) | (2, 7) | (2, 8) |
| 9 | (3, 5) | (3, 6) | (3, 7) | (3, 8) |
| 10 | (4, 5) | (4, 6) | (4, 7) | (4, 8) |
| 11 | (5, 5) | (5, 6) | (5, 7) | (5, 8) |
| 12 | (6, 5) | (6, 6) | (6, 7) | (6, 8) |
| 13 | (7, 5) | (7, 6) | (7, 7) | (7, 8) |
| . | . | . | . | . |
| . | . | . | . | . |

Namely, when data of a picture image (x, y), at the position of the x th row from the top and the y th column from the left side is defined on a liquid crystal panel, the data for 4 dots from the 1st–the 4th columns of the first row, i.e., (1, 1), (1, 2), (1, 3), (1, 4) are stored in a memory address 0; the data for 4 dots from the 1st –the 4th columns of the second row, i.e., (2, 1), (2, 2), (2, 3), (2, 4) are stored in a memory address 1; the data for 4 dots from the 1st–the 4th columns of the third row, i.e., (3, 1), (3, 2), (3, 3), (3, 4) are stored in a memory address 2; . . . the data for 4 dots from the 1st–the 4th columns of the seventh row, i.e., (7, 1), (7, 2), (7, 3), (7, 4) are stored in a memory address 6.

Then, the data for 4 dots from the 5th–the 8th columns of the first row, i.e. (1, 5), (1, 6), (1, 7), (1, 8) are stored in a memory address 7; the data for 4 dots from the 5th–the 8th columns of the second row, i.e. (2, 5), (2, 6), (2, 7), (2, 8) are stored in a memory address 8; . . . , the data for 4 dots from the 5th–the 8th columns of the seventh row, i.e., (7, 5), (7, 6), (7, 7), (7, 8) are stored in a memory address 13. In the same manner as noted above, the data for 120×240 dots are written in the memory.

Namely, the data on an L number of simultaneously selected row electrodes corresponding to the same column electrodes are stored in an L number of adjoining addresses. With such an arrangement, reading-out operations from a memory connected to the rear stage can be conducted at a high speed, and calculating operations can be easy.

The reading-out of the data from the memory 12 is conducted in response to a timing of driving the LCD with a fast serial access mode. Specifically, 16-bit data for 4 dots are successively read out from the memory address 0 while increasing the address number, and the readout data are supplied to be a gray shade determining circuit 15. The gray shade determining circuit 15 is a circuit adapted to transform gray shade data of 4 bits per 1 dot into 1-bit data without including a gray shade of ON or OFF to thereby form picture signals for subpictures, whereby a gray shade display is obtainable by repeating displays of subpictures at a plurality of cycles, (which is so-called frame modulation). Specifically, a demultiplexer for distributing 4-bit data to 1-bit data at a predetermined timing is used. Correspondence of certain bit data to certain subpictures is determined by count values by a frame counter. Thus, 16-bit data which corresponds to including any gray shade data of 4 dots which are serial data without including any gray shade information are outputted to the length-breadth transforming circuit 13. The data each having a 4-bit length are supplied seven times continuously to the length-breadth transforming circuit 13.

The length-breadth transforming circuit 13 comprises two sets of 4×7 bits registers so that writing and reading operations can be conducted simultaneously. Namely, the 4-bit data covering information from the 1st to 4th columns and 1st to 7th rows are stored in the length-breadth transforming circuit 13. When the stored data are read out, data each consisting of 7 bits which cover information from the 1st–the 7th rows of the first column are divided into four groups. The grouped data are supplied to a column signal generating circuit 14.

Figure 9:
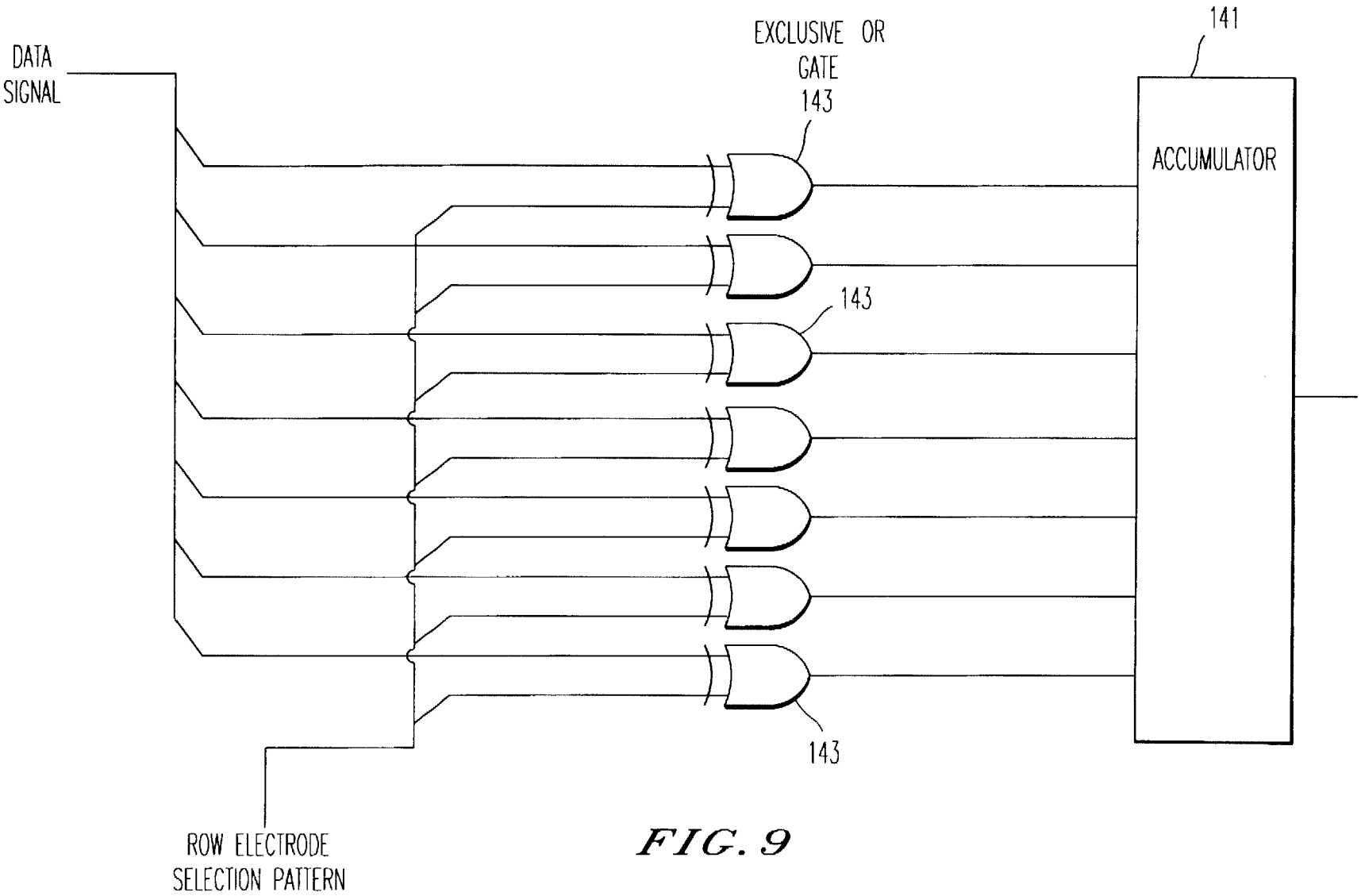
FIG. 9 is a block diagram showing an example of a column signal generating circuit used for the present invention.
Figure 10:
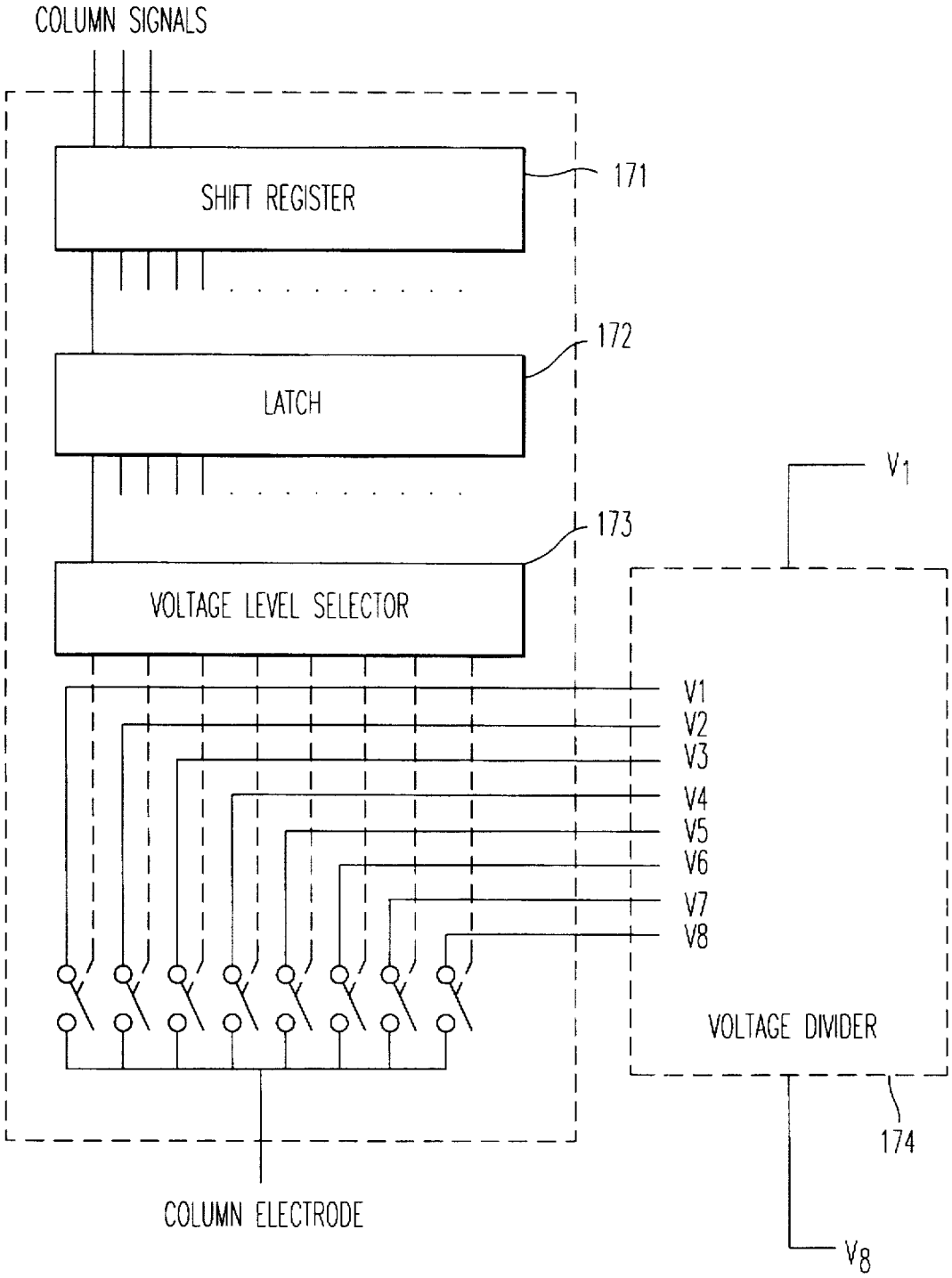
FIG. 10 is a block diagram showing an example of a column electrode driver used for the present invention.

The column signal generating circuit 14 conducts exclusive OR operations of the corresponding values between the inputted 7-bit data and 7-bit row selection patterns, and counts a numeral "1" from a result of the exclusive OR operations, whereby 3-bit data are outputted. The outputted data are supplied as display data to a column driver for a liquid crystal display module. The column signal generating circuit 14 has such a construction as shown in FIG. 9 for instance. Namely, signals consisting of 7-bit data are inputted to exclusive OR gates 143, 143 . . . The exclusive OR gates also receive signals from an orthogonal function generator. An output from each of the exclusive OR gates is supplied to an accumulator 141 in which the accumulation of the outputs are carried out for each simultaneously selected row electrodes. The display data are transformed into predetermined column voltages by the column driver with use of an appropriate buffer memory, and then, the column voltages are supplied to the column electrodes of the liquid crystal display element. The column driver has, for instance, a construction as shown in FIG. 10. The column driver is constituted by a shift register 171, a latch 172, a voltage level selector 173 and a voltage divider 174. A demultiplexer may be used for the voltage level selector 173. The column driver is so operated that after the data of a line of row electrodes have been supplied to the shift register 171, the transformation of the display data into the column voltages and the transformation of the orthogonal functions corresponding to orthogonal transformation numbers are simultaneously conducted. In this example, since data of a picture image inputted can be operated in non-synchronism with the data of the picture image to be read out, a control circuit having high flexibility can be provided.

EXAMPLE 2

Figure 6:
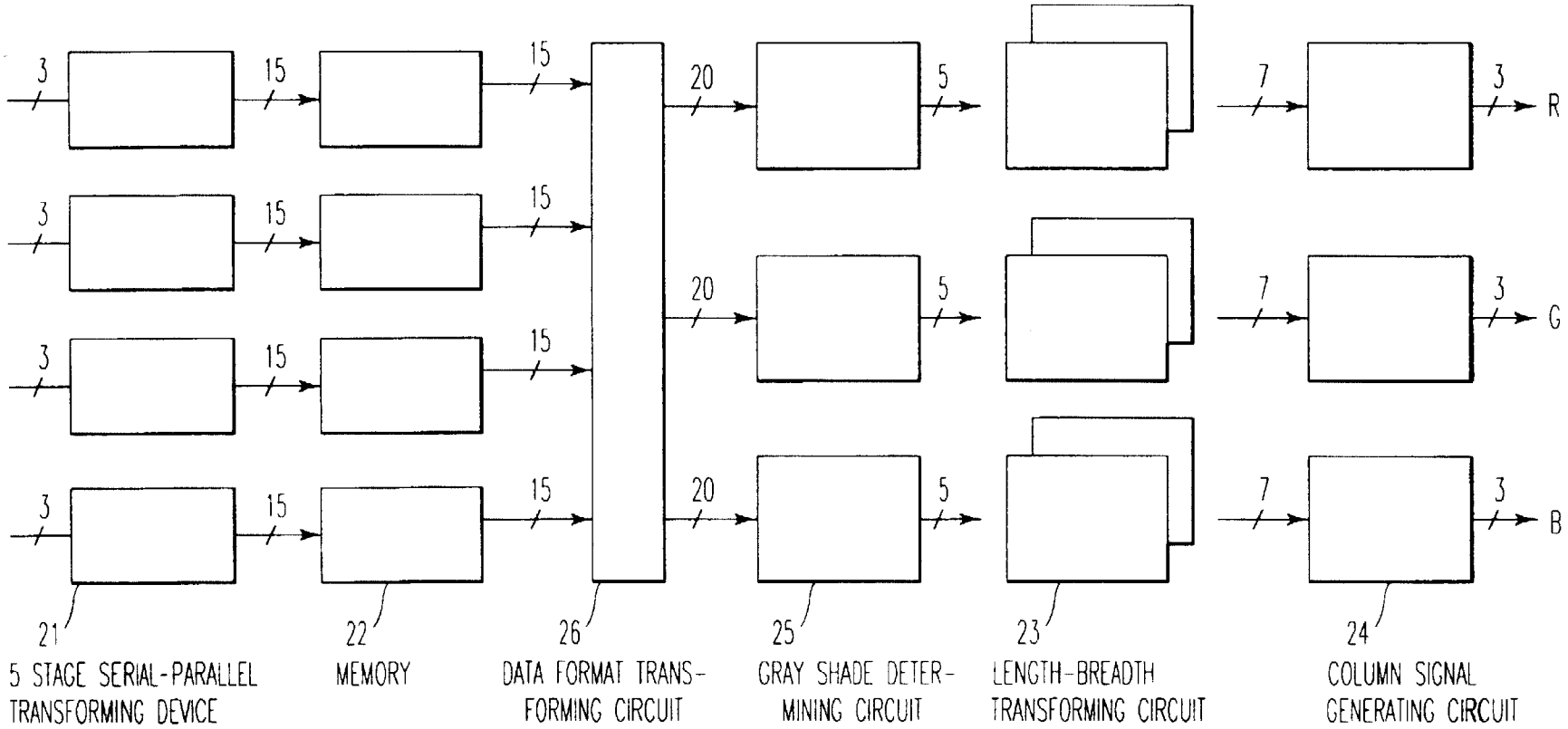
FIG. 6 is a block diagram showing a second embodiment of the present invention.

FIG. 6 shows an example of controlling a liquid crystal display panel comprising 640×3×480 dots with use of four memories. Supposing that the number of simultaneously selected lines is L=7 and a 16 gray shade display (i.e., 4-bit data are inputted for each color R, G, B) is provided by a frame modulation (disclosed, for instance, in Japanese Unexamined Patent Publication No. 24904/1994 and U.S. Pat. No. 5,262,881).

In processing signals, 4-bit picture image data having an information of gray shade are divided into four groups each consisting of 3 bits for R, G and B. Specifically, signals are divided into four groups: MSB ($2^3$), 2ndMSB ($2^2$), 3rdMSB ($2^1$), LSB ($2^0$) to be subjected to a parallel treatment.

The 3-bit data inputted are transformed into 15-bit data in 5-stage serial-parallel transforming devices 21. For the 5-stage serial-parallel transforming devices 21, 5-stage shift registers are used. Namely, serial data are inputted to input terminals of the 5-stage shift registers, and output from 5 tap terminals of the registers are inputted to memories 22.

VRAMs each comprising 16 bit length are used for the memories 22. The 15-bit data are written in the memories 22 in a format as shown in Table 2 by using a random access mode.

TABLE 2

| Address | Data of memory | | | | |
|---|---|---|---|---|---|
| 0 | (1, 1) | (1, 2) | (1, 3) | (1, 4) | (1, 5) |
| 1 | (2, 1) | (2, 2) | (2, 3) | (2, 4) | (2, 5) |
| 2 | (3, 1) | (3, 2) | (3, 3) | (3, 4) | (3, 5) |
| 3 | (4, 1) | (4, 2) | (4, 3) | (4, 4) | (4, 5) |
| 4 | (5, 1) | (5, 2) | (5, 3) | (5, 4) | (5, 5) |
| 5 | (6, 1) | (6, 2) | (6, 3) | (6, 4) | (6, 5) |
| 6 | (7, 1) | (7, 2) | (7, 3) | (7, 4) | (7, 5) |
| 7 | (1, 6) | (1, 7) | (1, 8) | (1, 9) | (1, 10) |
| 8 | (2, 6) | (2, 7) | (2, 8) | (2, 9) | (2, 10) |
| 9 | (3, 6) | (3, 7) | (3, 8) | (3, 9) | (3, 10) |
| 10 | (4, 6) | (4, 7) | (4, 8) | (4, 9) | (4, 10) |
| 11 | (5, 6) | (5, 7) | (5, 8) | (5, 9) | (5, 10) |
| 12 | (6, 6) | (6, 7) | (6, 8) | (6, 9) | (6, 10) |
| 13 | (7, 6) | (7, 7) | (7, 8) | (7, 9) | (7, 10) |
| . | . | . | . | . | . |
| . | . | . | . | . | . |

Namely, when data of a picture image (x, y) at the position of the x th row from the top and the y th column from the left is defined on a display panel, data for 5 dots from the 1st–the 5th columns of the first row, i.e. (1, 1), (1, 2), (1, 3), (1, 4), (1, 5) are stored in a memory address 0; data for 5 dots from the 1st–the 5th columns of the second row, i.e., (2, 1), (2, 2), (2, 3), (2, 4), (2, 5) are stored in a memory address 1; data for 5 dots from the 1st–the 5th columns of the third row, i.e. (3, 1), (3, 2), (3, 3), (3, 4), (3, 5) are stored in a memory address 2; . . . . data for 5 dots from the 1st–the 5th columns of the seventh row, i.e. (7, 1), (7, 2), (7, 3), (7, 4), (7, 5) are stored in a memory address 6.

Then, the data for 5 dots from the 6th–the 10th columns of the first row, i.e., (1, 6), (1, 7), (1, 8), (1, 9), (1, 10) are stored in a memory address 7; the data for 5 dots from the 6th–the 10th columns of the second row, i.e., (1, 6), (1, 7), (1, 8), (1, 9), (1, 10) are stored in a memory address 7; the data for 5 dots from the 6th–the 10th columns of the second row, i.e., (2, 6), (2, 7), (2, 8), (2, 9), (2, 10) are stored in a memory address 8; . . . . the data for 5 dots from the 6th–the 10th columns of the seventh row, i.e., (7, 6), (7, 7), (7, 8), (7, 9), (7, 10) are stored in a memory address 13. In the same manner as the above, the data for 640×480 dots are written in the memories.

Namely, the data on an L number of simultaneously selected row electrodes corresponding to the same column electrodes are stored in an L number of adjoining addresses. With such an arrangement, reading-out of data from memories connected to the rear stage can be conducted at a high speed, and calculating operations can be easy.

The reading-out of the data from the memory 22 can be conducted in response to a timing of driving the LCD with a fast serial access mode. Specifically, 15-bit data are successively readout from the memory address 0 while increasing the address number, and the 15-bit data of four groups are supplied to a data format transforming circuit 26.

The data format transforming circuit 26 is a circuit which rearranges data having a 15-bit length for each gray shade level supplied in parallel into parallel signals having a 20-bit length for each of R, G and B. Generally, the circuit 26 has an appropriate wiring on a circuit substrate.

The 20-bit data of each group of R, G and B which have been transformed in the data format transforming circuit 26 are supplied to gray shade determining circuits 25. The gray shade determining circuits 25 are frame modulating circuits which transform gray shade data of 4 bits per 1 dot into data of 1 bit of ON or OFF to thereby form picture signals for subpictures, whereby a gray shade display is obtainable by displaying the subpictures during 15 cycles. Specifically, demultiplexers for distributing the 20-bit length data into 5-bit length data at a predetermined timing are used. The correspondence of certain bit data to certain subpictures is determined by count values in a frame counter. Thus, 20-bit data which correspond to gray shade data for 5 dots are transformed into 5-bit serial data without any gray shade, and the transformed serial data are outputted to length-breadth transforming circuits 23.

The 5-bit length data are supplied seven times continuously to the length-breadth transforming circuits 23. Each of the circuits 23 comprises two sets of 5×7 bit registers so that writing and reading can be conducted simultaneously. Namely, the 5-bit data covering information from the 1st–the 7th row of the first–the fifth column are stored in the length-breadth transforming circuits 23. When the stored data are read out, 7-bit data which cover information from the 1st–the 7th row of the first column are divided into 5 groups and the divided data are supplied to column signal generating circuits 24.

Each of the column signal generating circuits 24 conducts exclusive OR operations of the corresponding values between the inputted 7-bit data and 7-bit row selection patterns, and counts a numeral "1" from a result of the exclusive OR operations, whereby 3-bit data are outputted. The outputted data are supplied as display data to a column driver. The display data are transformed into predetermined column voltages in the column driver, and the column voltages are applied to column electrodes of the liquid crystal display element. The column signal generating circuits and the column driver may be the same as those used in Example 1.

In the same manner as Example 1, a control circuit having high flexibility can be formed because the picture image data inputted can be operated in non-synchronism with the picture image data read out from the memory.

EXAMPLE 3

Figure 7:
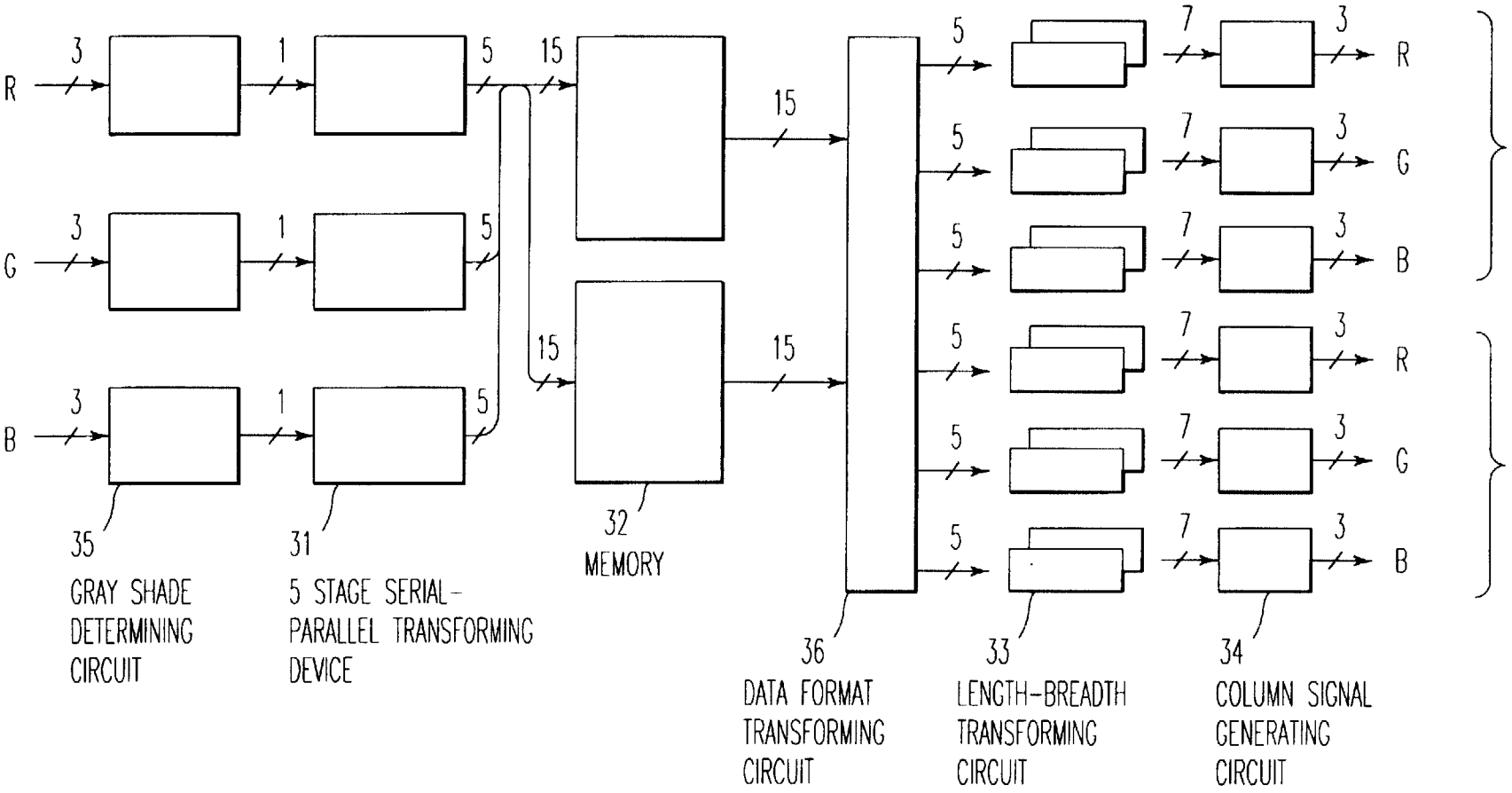
FIG. 7 is a block diagram showing a third embodiment of the present invention.

FIG. 7 shows an example of controlling a liquid crystal display panel comprising 640×3×480 dots with use of two memories.

Supposing that the number of simultaneously selected lines is L=7, and an 8 gray shade display (i.e., 3-bit data are inputted for each of R, G and B) is provided by a frame modulation (disclosed, for instance, in Japanese Unexamined Patent Publication No. 27904/1994 and U.S. Pat. No. 5,262,881). Also, in the liquid crystal display panel, 2-picture driving is to be conducted. Namely, a display area is divided into two portions, which are driven independently.

In a conventional circuit structure wherein gray shade determining circuits are located in rear of frame buffer memories, the same number of the gray shade determining circuits as the number of simultaneously selected lines are required. Further, the capacity of the frame buffer memories is increased because it is necessary to store picture image data of multi-bits including information of gray shade levels.

The column signal forming device according to this Example comprises, as shown in FIG. 7, gray shade determining circuits 35, 5-stage serial-parallel transforming devices 31, memories (VRAMS) 32, data format transforming devices 36, length-breadth transforming circuits 33 and column signal generating circuits 34.

Picture image data each consisting of 3 bits including gray shade information for each of R, G and B are inputted to the gray shade determining circuits 35 in which the picture image data are transformed into data of 1 bit of ON or OFF for each display cycle in correspondence to inputted picture image data as shown in Table 3. In Table 3, numerals 1 through 7 in the column the outputs of picture image data indicate display cycles, namely, 3-bit display data are transformed into outputs of 1 bit×7 times.

TABLE 3

| Picture image data input | | | Output | | | | | | |
|---|---|---|---|---|---|---|---|---|---|
| MSB | 2ndMSB | LSB | 1 | 2 | 3 | 4 | 5 | 6 | 7 |
| 0 | 0 | 0 | 0 | 0 | 0 | 0 | 0 | 0 | 0 |
| 0 | 0 | 1 | 0 | 0 | 0 | 1 | 0 | 0 | 0 |
| 0 | 1 | 0 | 0 | 1 | 0 | 0 | 0 | 1 | 0 |
| 0 | 1 | 1 | 0 | 1 | 0 | 1 | 1 | 1 | 0 |
| 1 | 0 | 0 | 1 | 0 | 1 | 0 | 1 | 0 | 1 |
| 1 | 0 | 1 | 1 | 0 | 1 | 1 | 1 | 0 | 1 |
| 1 | 1 | 0 | 1 | 1 | 1 | 0 | 1 | 1 | 1 |
| 1 | 1 | 1 | 1 | 1 | 1 | 1 | 1 | 1 | 1 |

Specifically, demultiplexers for distributing 3-bit data to 1-bit data at a predetermined timing are used. The correspondence of certain bit data to certain subpictures is determined by count values in a frame counter. Thus, the 3-bit data corresponding to gray shade data for 1 dot are transformed into 1-bit serial data without gray shade information, and the 1-bit serial data are outputted to the 5-stage serial-parallel converting devices 31.

The 1-bit serial data inputted to the 5-stage serial-parallel transforming devices 31 are transformed into data of 5-bit length. As the 5-stage serial-parallel transforming devices 31, 5-stage shift registers are used in the same manner as Example 2. Namely, the serial data are inputted to input terminals of the 5-stage shift registers, and outputs from 5 tap terminals are inputted to the memories 32.

The data input to the memories (frame buffer memories) 32 is effected by simultaneously supplying 15-bit data for R, G and B. The data are written in the memories 32 in a format as shown in Table 2 by using a random access mode. In this case, values corresponding to (x, y) in Table 2 represent 3 dots for R, G or B.

Namely, when the data of a picture image (x, y) at the position of the xth row from the top and the yth column from the left is defined in a display panel, the data for 5 pixels for R, G and B from the 1st–the 5th column of the first row, i.e., (1, 1), (1, 2), (1, 3), (1, 4), (1, 5) are stored in a memory address 0; the data for 5 pixels from the 1st–the 5th column of the second row, i.e. (2, 1), (2, 2), (2, 3), (2, 4), (2, 5) are stored in a memory address 1; the data for 5 pixels from 1st–the 5th column of the third row, i.e., (3, 1), (3, 2), (3, 3), (3, 4), (3, 5) are stored in a memory address 2; . . . , the data for 5 pixels from the 1st–the 5th column of the seventh row, i.e., (7, 1), (7, 2), (7, 3), (7, 4), (7, 5) are stored in a memory address 6.

Then, the data for 5 pixels from the 6th–the 10th column of the first row, i.e., (1, 6), (1, 7), (1, 8), (1, 9), (1, 10) are stored in a memory address 7; the data for 5 pixels from the 6th–the 10th column of the second row, i.e., (2, 6), (2, 7), (2, 8), (2, 9), (2, 10) are stored in a memory address 8; . . . , the data for 5 pixels from the 6th–the 10th column of the seventh row, i.e. (7, 6), (7, 7), (7, 8), (7, 9), (7, 10) are stored in a memory address 13. In the same manner as the above, data for 640×480 pixels are written in the memories.

Namely, the data on an L number of simultaneously selected row electrodes corresponding to the same column electrode are stored in an L number of adjoining addresses. With such an arrangement, the reading-out of data from memories connected to the rear stage can be conducted at a high speed, and calculating operations can be easy.

The reading-out of the data from the memories 32 are conducted by using a first serial access mode. Specifically, 15-bit data are successively read out from the memory address 0 while increasing the address number to thereby prepare two sets of 15-bit data, which are supplied to the data format transforming circuits 36.

Each of the data format transforming circuits 36 is a circuit which transforms the two sets of data of a 15-bit length received in parallel into three sets of parallel signals of a 5-bit length for R, G and B. Generally, the circuit 36 has an appropriate wiring on a circuit substrate. In this Example, a two picture driving system is conducted, and accordingly, two groups of parallel data are formed for the data for an upper half portion and a lower half portion of the liquid crystal display element.

The data are supplied seven times continuously to the length-breadth transforming circuits 33. Each of the circuits 33 comprises two sets of 5×7 bit registers so that the reading and writing can be effected simultaneously. Namely, 5-bit data covering information of the 1st–the 7th row of the 1st–the 5th column are stored in the length-breadth transforming circuits 33. When the stored data are read out, 7-bits covering information of the 1st–the 7th row of the first column are divided into 5 groups, and the divided data are supplied to the column signal generating circuits 34.

The column signal generating circuits 34 conduct exclusive OR operations of the corresponding values between the inputted 7-bit data and 7-bit row selection patterns, and count a numeral "1" from a result of the exclusive OR operations, whereby 3-bit data are outputted. The outputted data are supplied as display data to a column driver. The display data are transformed into predetermined column voltages in the column driver and the column voltages are applied to column electrodes of the liquid crystal display element. The column signal generating circuits and the column driver may be the same as the circuits used in Example 1.

In this Example, since the picture image data inputted are operated in synchronism with the operation of the picture image data read out from the memories, a speed of reading-out of the data from the memories depends on a speed of inputting the data. Accordingly, the number of bits for the data to be treated can be reduced to thereby simplify the construction of the circuits because the gray shade determining circuits are located in front of the memories. However, flexibility in controlling the liquid crystal display panel is more or less limited.

EXAMPLE 4

Figure 8:
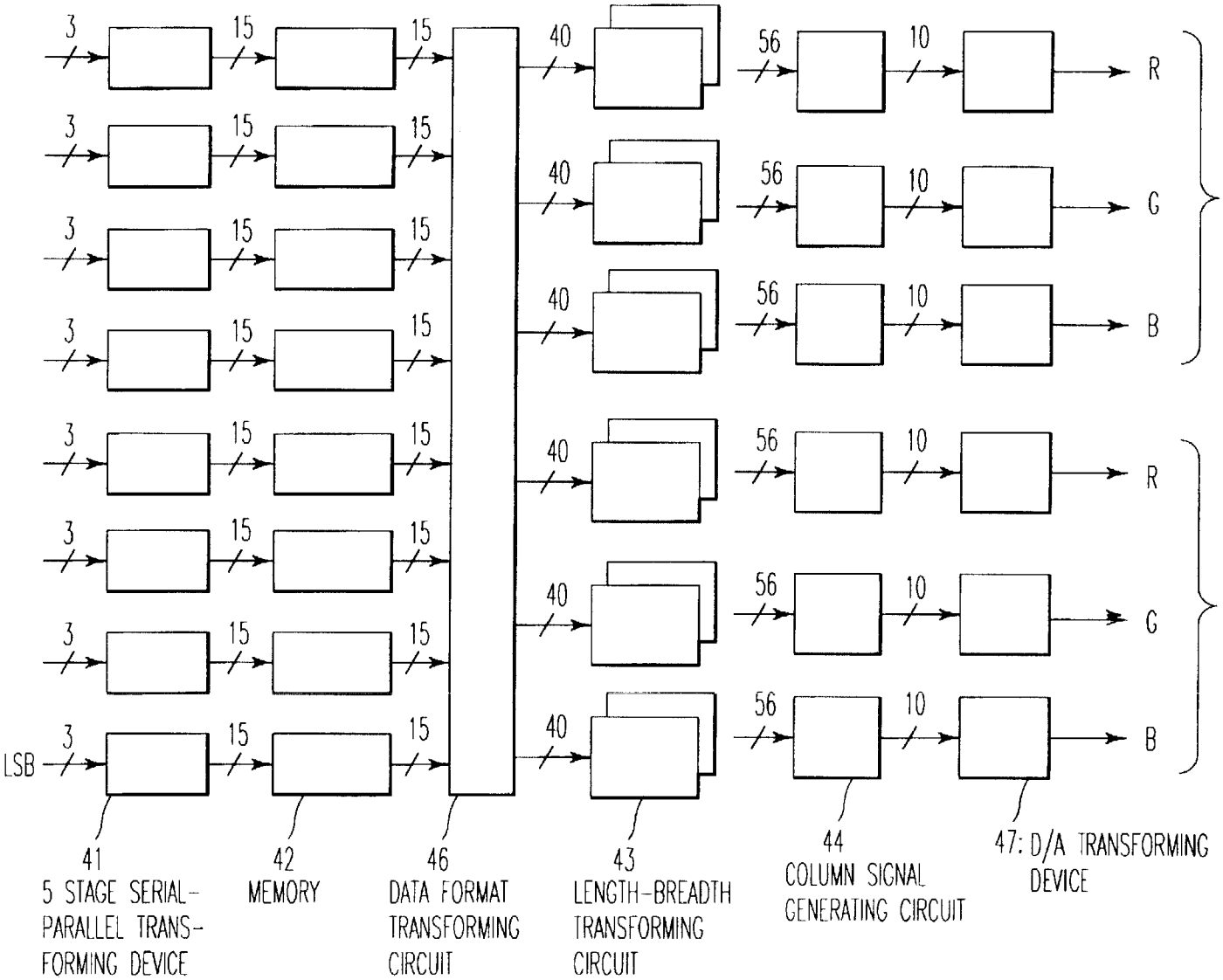
FIG. 8 is a block diagram showing a fourth embodiment of the present invention.

FIG. 8 shows an example of controlling a liquid crystal display panel of 640×3×480 dots with use of 8 memories.

Supposing that the number of simultaneously selected lines is L=7, and a 256 gray shade display (8-bit data are inputted for each color of R, G and B) is provided by an amplitude modulation (disclosed, for instance, in Japanese Patent Application No. 222053/1992 and U.S. Ser. No. 08/098,812).

In a signal processing, 8-bit picture image data having a gray shade information are divided into 8 groups of 3-bit data for R, G and B, i.e. MSB ($2^7$), 2ndMSB ($2^6$), 3rdMSB ($2^5$), 4thMSB ($2^4$), 5thMSB ($2^3$), 6thMSB ($2^2$), 7thMSB ($2^1$) and LSB ($2^0$). The 8 groups of signals are subjected to a parallel processing.

The 3-bit data inputted are transformed into 15-bits data in 5-stage serial-parallel transforming devices 41, and then, supplied to memories 42. Specifically, 5-stage shift registers are used for the 5-stage serial-parallel transforming devices 41. Namely, serial data are inputted to input terminals of the 5-stage shift registers, and outputs from 5 tap terminals are inputted to the memories 22.

VRAMs comprising 16 bit length are used for the memories 42. The writing of the data in the memories 42 are conducted in a format as shown in Table 2 by using a random access mode.

Namely, when definition is made as to data (x, y) on a liquid crystal panel, the data for 5 dots of the 1st–the 5th column of the first row, i.e., (1, 1), (1, 2), (1, 3), (1, 4), (1, 5) are stored in a memory address 0; the data for 5 dots of the 1st–the 5th column of the second row, i.e., (2, 1), (2, 2), (2, 3), (2, 4), (2, 5) are stored in a memory address 1; the data for 5 dots of the 1st–the 5th column of the third rows, i.e., (3, 1), (3, 2), (3, 3), (3, 4), (3, 5) are stored in a memory address 2; . . . , the data for 5 dots of the 1st–the 5th column of the seventh row, i.e., (7, 1), (7, 2), (7, 3), (7, 4), (7, 5) are stored in a memory address 6.

Then, the data for 5 dots of the 6th–the 10th column of the first row, i.e., (1, 6), (1, 7), (1, 8), (1, 9), (1, 10) are stored in a memory address 7; the data for 5 dots of the 6th–the 10th column of the second row, i.e., (2, 6), (2, 7), (2, 8), (2, 9), (2, 10) are stored in a memory address 8; . . . , the data for 5 dots of the 6th–the 10th column of the seventh row, i.e., (7, 6), (7, 7), (7, 8), (7, 9), (7, 10) are stored in a memory address 13. In the same manner as the above, data for 640×480 dots are written in the memories. Namely, the data on an L number of simultaneously selected row electrodes corresponding to the same column electrodes are stored in an L number of adjoining addresses. With such an arrangement, the reading-out of the data from memories can be conducted at a high speed, and calculating operations can be easy.

The reading-out of the data from the memories 42 are conducted at a timing of driving the LCD with a fast serial access mode. Specifically, 15-bit data are successively read out from the memory address 0 while increasing the address number, and 8 groups of 15-bit data are supplied to the data format transforming circuits 46.

Each of the data format transforming circuits 46 is a circuit which transforms the 15-bit length data for each gray shade level supplied in parallel into 3 groups of 40-bit data (8 bits×5 dots) for R, G and B. Generally, the circuit 46 has an appropriate wiring on a circuit substrate. In this Example, a two picture driving system is effected, and accordingly, the data are transformed into two groups of parallel data for an upper half portion and a lower half portion of the liquid crystal display element.

The data are transformed into three groups of 40-bit data for R, G and B in the data format transforming circuits 46 so that the transformed data are applicable to the upper and lower picture planes, and the data are supplied to length-breadth transforming circuits 43. The signals to the circuits 43 are outputted continuously seven times. Each of the length-breadth transforming circuits 43 comprises two sets of 5×7 bit registers for 1 dot. Namely, 40-bits (8 bits×5 dots) data covering information from the 1st–the 7th row of the first column of the circuit 43 are stored.

Data of 56 bits from the 1st–the 7th row of the first column are divided into 5 groups of data to be read out, and the readout data are supplied to column signal generating circuits 44.

Each of the column signal generating circuits 44, as described in Japanese Patent Application No. 222053/1993 and U.S. Ser. No. 08/098,812, is adapted to conduct operations of seven display data in the column direction and seven row selection pattern vectors, and supply the operated data to D/A converting circuits 47. Each of the column signal generating circuits 44 may be the column signal generating circuit, as in Examples 1–3, with which a correction signal generating device is connected in parallel.

Figure 11:
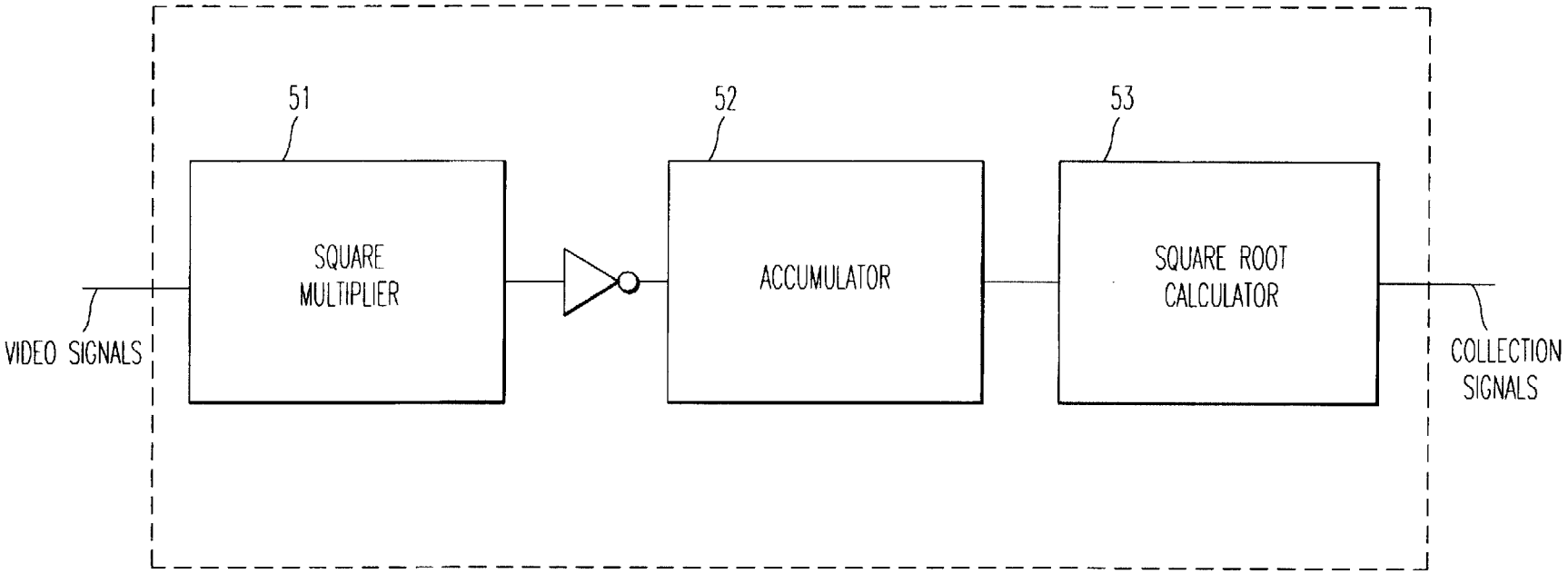
FIG. 11 is a block diagram showing an example of a correction signal generating circuit applicable to the present invention.
Figure 12:
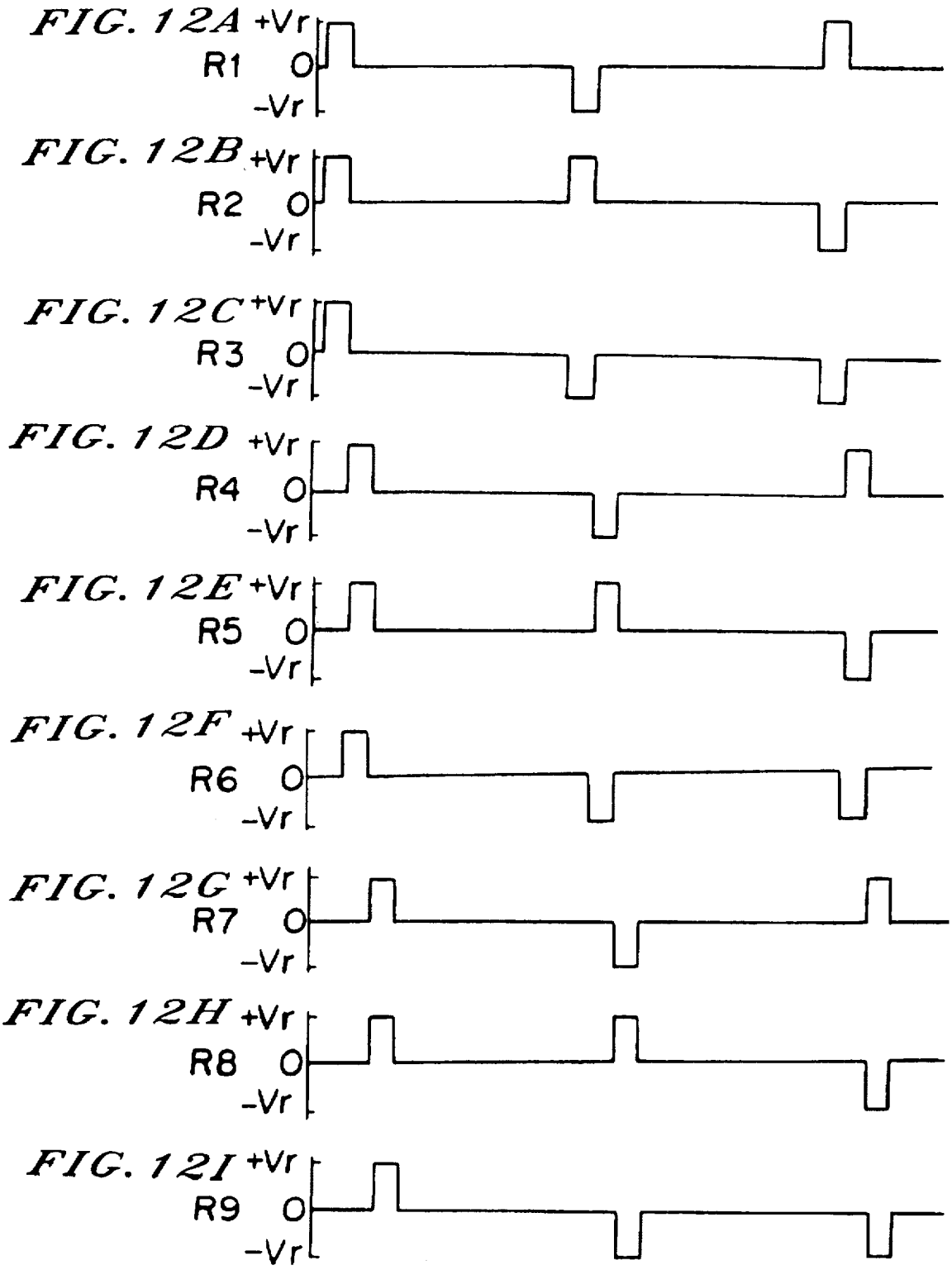
FIGURE 12 PRIOR ART
FIG. 12 is a diagram showing an example of row electrode waveforms in a MLS method.

A correction signal can be formed in a circuit as shown in FIG. 11. Namely, the square value of picture signals on a column of simultaneously selected row electrodes is calculated by a square multiplier 151. The complement of the calculated values are added by an accumulator 152 for the simultaneously selected row electrodes. Then, the added value is operated in a square root calculator 153, whereby a correction signal is obtainable.

The thus obtained correction signal is supplied to the D/A converting circuit 47 in parallel to the output of the circuit as shown in FIG. 9. The D/A converting circuit 47 converts inputted digital signals into analogue signals whereby the analogue signals are supplied as display data to a column driver of a liquid crystal display module. The display data are transformed into predetermined column voltages in the column driver and the column voltages are applied to column electrodes of the liquid crystal display element.

The present invention enables the use of inexpensive dynamic memories; to reduce the number of the memories and to simplify the construction of a circuit while a high speed operation of column voltages necessary for a MLS driving method can be obtained.

The reading-out of data in a writing/reading step is conducted by using a serial access mode which is faster than a random access mode, whereby a fast operation is possible at a low cost.

Further, in driving the liquid crystal display apparatus, a gray shade display is obtainable by distributing a picture to a plurality of subpictures. In addition, a fast operation of column signals as well as the gray shade display is possible by using, after the writing/reading step, a gray shade determining step wherein picture signals for the subpictures are formed by transforming parallel picture signals into 1-bit data for 1 dot-1 color. Further, in driving the liquid crystal display apparatus, a gray shade display is obtainable by distributing a picture to a plurality of subpictures and by displaying the subpictures continuously. In addition, the gray shade display becomes possible; the number of bits for data to be processed can be reduced, and the construction of a circuit can be simplified by using a gray shade determining step wherein picture signals for the subpictures are formed by transforming serial picture signals including a gray shade information into 1-bit data for 1 dot-1 color, before a serial-parallel transforming step.

Further, the adjustment of data is possible, in a case that the bit length of data from a memory is different from the number of simultaneously selected row electrodes, by using before an operation step, a length-breadth transforming step wherein the number of the simultaneously selected row electrodes is L and the data of an L number of continuous data of a K-bit length are transformed into the data of a K number of continuous data of an L-bit length.

Further, in the operation step, a correction signal to be included in a column signal is formed so that an effective voltage applied to a pixel in a non-selection time is substantially constant to any pixel, in parallel to operations wherein parallel picture signals read out from a memory is transformed by an orthogonal function into an orthogonal transformation signal. The correction signal enables to obtain an excellent display free from a crosstalk.

Obviously, numerous modifications and variations of the present invention are possible in light of the above teachings. It is therefore to be understood that within the scope of the appended claims, the invention may be practiced otherwise than as specifically described herein.

What is claimed is:

1. A method of forming column signals for driving a liquid crystal display apparatus having a plurality of row electrodes and a plurality of column electrodes wherein a plurality L of the row electrodes are simultaneously selected as a batch, where L is an integer; the column electrodes are applied with voltages based on orthogonal transformation signals which are obtained by transforming inputted picture signals corresponding to the positions of the simultaneously selected row electrodes on a panel by an orthogonal function, and the row electrodes are applied with the voltages based on the orthogonal function, wherein column signals are formed from the picture signals corresponding to the positions of the simultaneously selected row electrodes on the panel by comprising the steps of:

a serial-parallel transforming step of transforming the inputted picture signals into picture signals having a predetermined bit length, a writing/reading step of reading the picture signals having the predetermined bit length after the picture signals have once been written in at least one memory having a plurality of sequential addresses;

an operating step of transforming by the orthogonal function the picture signals readout from the at least one memory into the orthogonal transformation signals, wherein a random access mode is used for writing the picture signals in the at least one memory in the writing/reading step, and data on the row electrodes corresponding to a same column electrode are stored in a L number of adjoining addresses with respect to the L number of simultaneously selected row electrodes such that the data for one row electrode is distributed to be written in non-continuous of the sequential addresses of the at least one memory; and a length-breadth transforming step for outputting a column vector corresponding to the data stored in the L number of adjoining addresses for the data of the same column electrode.

2. The method of forming column signals according to claim 1, wherein a serial access mode which is faster than the random access mode is used for reading the picture signals in the writing/reading step.

3. The method of forming column signals according to claim 1, wherein in driving the liquid crystal display apparatus, a picture consists of a plurality of successive subpictures and the subpictures are continuously displayed to obtain a gray shade display, and which further comprises a gray shade determining step of forming picture signals for the subpictures by transforming the picture signals into data of 1 bit for each 1 dot·1 color, after the writing/reading step.

4. The method of forming column signals according to claim 1, wherein in driving the liquid crystal display apparatus, each of the inputted picture signals comprises a plurality of successive subpictures and the subpictures are continuously displayed to obtain a gray shade display, and which further comprises a gray shade determining step of forming picture signals for the subpictures by transforming the picture signals including a gray shade level into data of 1 bit for each 1 dot 1 color, before the serial-parallel transforming step.

5. The method of forming column signals according to claim 1, wherein the length-breadth transforming step transforms the data stored in the L number of adjoining addresses and having a K bit length into a K number of continuous data having a L bit length before the operating step wherein the number of simultaneously selected row electrodes is L.

6. The method of forming column signals according to claim 1, wherein when the operating step is conducted in parallel to the operation of transforming, by the orthogonal function, the picture signals readout from the memory into the orthogonal transformation signals, correction signals are formed to be included in the column signals so that effective voltages to be applied to pixels in a non-selection time take substantially the same value for the pixels.

7. A method of forming column signals for driving a liquid crystal display apparatus having a plurality of row electrodes and a plurality of column electrodes wherein a plurality L of the row electrodes are simultaneously selected as a batch, wherein L is an integer; the column electrodes are applied with voltages based on orthogonal transformation signals which are obtained by transforming inputted picture signals corresponding to the positions of the simultaneously selected row electrodes on a panel by an orthogonal function, and the row electrodes are applied with the voltages based on the orthogonal function, wherein column signals are formed from the picture signals corresponding to the positions of the simultaneously selected row electrodes on the panel by comprising the steps of:

a serial-parallel transforming step of transforming the inputted picture signals into picture signals having a predetermined bit length;

a writing/reading step of reading the picture signals having the predetermined bit length after the picture signals have once been written in at least one memory having a plurality of sequential addresses; and an operating step of transforming by the orthogonal function the picture signals read out from the at least one memory into the orthogonal transformation signals, wherein a random access mode is used for writing the picture signals in the at least one memory in the writing/reading step, and data on the row electrodes corresponding to a same column electrode are stored in a L number of adjoining addresses with respect to the L number of simultaneously selected row electrodes, such that the data for one row electrode is distributed to be written in non-continuous of the sequential addresses of the at least one memory.

8. The method of forming column signals according to claim 7, wherein a serial access mode which is faster than the random access mode is used for reading the picture signals in the writing/reading step.

9. The method of forming column signals according to claim 7, wherein in driving the liquid crystal display apparatus, a picture comprises a plurality of successive subpictures and the subpictures are continuously displayed to obtain a gray shade display, and which further comprises a gray shade determining step of forming picture signals for the subpictures by transforming the picture signals into data of 1 bit for each 1 dot·1 color, after the writing/reading step.

10. The method of forming column signals according to claim 7, wherein in driving the liquid crystal display apparatus, each of the inputted picture signals comprises a plurality of successive subpictures and the subpictures are continuously displayed to obtain a gray shade display, and which further comprises a gray shade determining step of forming picture signals for the subpictures by transforming the picture signals including a gray shade level into data of 1 bit for each 1 dot·1 color, before the serial-parallel transforming step.

11. The method of forming column signals according to claim 7, further comprising a length-breadth transforming step for writing the picture signals stored in the at least one memory into a register, and for outputting a column vector corresponding to the data stored in the L number of adjoining addresses for the data of the same column electrode.

12. The method of forming column signals according to claim 11, wherein the length-breadth transforming step transforms the data stored in the L number of adjoining addresses and having a K bit length into a K number of continuous data having an L bit length before the operating step wherein the number of simultaneously selected row electrodes is L.

13. The method of forming column signals according to claim 7, wherein when the operating step is conducted in parallel to the operation of transforming, by the orthogonal function, the picture signals read out from the memory into the orthogonal transformation signals, correction signals are formed to be included in the column signals so that effective voltages to be applied to pixels in a non-selection time take substantially the same value for the pixels.

* * * * *